US009871299B2

(12) United States Patent
Ganchrow et al.

(10) Patent No.: US 9,871,299 B2
(45) Date of Patent: Jan. 16, 2018

(54) CAVITY BACKED APERTURE ANTENNA

(71) Applicant: QUALCOMM Incorporated, San Diego, CA (US)

(72) Inventors: Elimelech Ganchrow, Zichron Yaakov (IL); Alon Yehezkely, Haifa (IL)

(73) Assignee: QUALCOMM Incorporated, San Diego, CA (US)

( * ) Notice: Subject to any disclaimer, the term of this patent is extended or adjusted under 35 U.S.C. 154(b) by 123 days.

(21) Appl. No.: 14/560,598

(22) Filed: Dec. 4, 2014

(65) Prior Publication Data

US 2016/0164186 A1 Jun. 9, 2016

(51) Int. Cl.

| | |
|---|---|
| ***H01Q 13/18*** | (2006.01) |
| ***H01Q 1/24*** | (2006.01) |
| *H01Q 13/02* | (2006.01) |
| *H01Q 21/24* | (2006.01) |
| *H01Q 21/28* | (2006.01) |

(52) U.S. Cl.

CPC ..... *H01Q 13/18* (2013.01); *H01Q 1/243* (2013.01); *H01Q 13/02* (2013.01); *H01Q 21/24* (2013.01); *H01Q 21/28* (2013.01)

(58) Field of Classification Search

CPC ..... H01C 13/18; H01C 1/243; H01C 13/10
USPC ..... 343/702, 767, 771
See application file for complete search history.

(56) References Cited

U.S. PATENT DOCUMENTS

| | | | | |
|---|---|---|---|---|
| 4,197,545 | A | 4/1980 | Favaloro et al. | |
| 6,483,466 | B2 | 11/2002 | Liu | |
| 7,446,710 | B2 | 11/2008 | Wu et al. | |
| 2005/0146475 | A1 | 7/2005 | Bettner et al. | |
| 2008/0238792 | A1 | 10/2008 | Heinrich et al. | |
| 2009/0066597 | A1* | 3/2009 | Yang | H01P 3/121 343/771 |
| 2010/0156728 | A1* | 6/2010 | Alvey | H01Q 1/243 343/702 |
| 2011/0050509 | A1 | 3/2011 | Ayala Vazquez et al. | |
| 2012/0212384 | A1* | 8/2012 | Kam | H01Q 1/2283 343/767 |
| 2013/0088396 | A1* | 4/2013 | Han | H01Q 9/04 343/700 MS |
| 2013/0099983 | A1 | 4/2013 | Han et al. | |
| 2014/0240186 | A1* | 8/2014 | Zhou | H01Q 13/06 343/772 |
| 2014/0320364 | A1* | 10/2014 | Gu | H01Q 13/0225 343/786 |
| 2015/0009075 | A1* | 1/2015 | Lau | H01Q 21/28 343/702 |

(Continued)

FOREIGN PATENT DOCUMENTS

| | | | | |
|---|---|---|---|---|
| KR | 101454878 | B1 | 11/2014 | |
| WO | WO 2014154231 | A1 * | 10/2014 | H01Q 13/18 |

OTHER PUBLICATIONS

International Search Report and Written Opinion for International Application No. PCT/US2015/061240, ISA/EPO, dated Feb. 22, 2016.

*Primary Examiner* — Dameon E Levi
*Assistant Examiner* — David Lotter
(74) *Attorney, Agent, or Firm* — Qualcomm Incorporated—Toler

(57) ABSTRACT

An apparatus includes a first metal region of a substrate, a second metal region of the substrate, and vias that electrically connect the first metal region to the second metal region to define a cavity of a slot aperture antenna.

20 Claims, 7 Drawing Sheets

(56) References Cited

U.S. PATENT DOCUMENTS

2015/0070231 A1* 3/2015 Park ..... H01Q 3/24
343/777

* cited by examiner

CAVITY BACKED APERTURE ANTENNA

I. FIELD

The present disclosure is generally related to antennas.

II. DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and Internet protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player. Also, such wireless telephones can process executable instructions, including software applications, such as a web browser application, that can be used to access the Internet. As such, these wireless telephones can include significant computing capabilities.

For 60 gigahertz (GHz) wireless systems, it is desirable to include multiple antennas in a single device to increase transmission and reception capabilities of the device. With the reduction in size of a system in package (SiP) that includes a radio frequency integrated circuit within a mobile communication device, it has become difficult to place a large numbers of antennas in the SiP. In addition, the SiP may be in a metallization environment (e.g., near metal of a mobile phone housing), and it would be desirable for the antennas to operate with nearby metallization. One past approach to increase the number of antennas is to use edge dipole antennas that utilize an edge of a printed circuit (PC) board, but such edge dipole antennas are not designed to work in close proximity to metal.

III. BRIEF DESCRIPTION OF THE DRAWINGS

IV. DETAILED DESCRIPTION

The detailed description set forth below is intended as a description of exemplary designs of the present disclosure and is not intended to represent the only designs in which the present disclosure can be practiced. The term "exemplary" is used herein to mean "serving as an example, instance, or illustration." Any design described herein as "exemplary" is not necessarily to be construed as preferred or advantageous over other designs. The detailed description includes specific details for the purpose of providing a thorough understanding of the exemplary designs of the present disclosure. It will be apparent to those skilled in the art that the exemplary designs described herein may be practiced without these specific details. In some instances, well-known structures and devices are shown in block diagram form in order to avoid obscuring the novelty of the exemplary designs presented herein.

Figure 1:
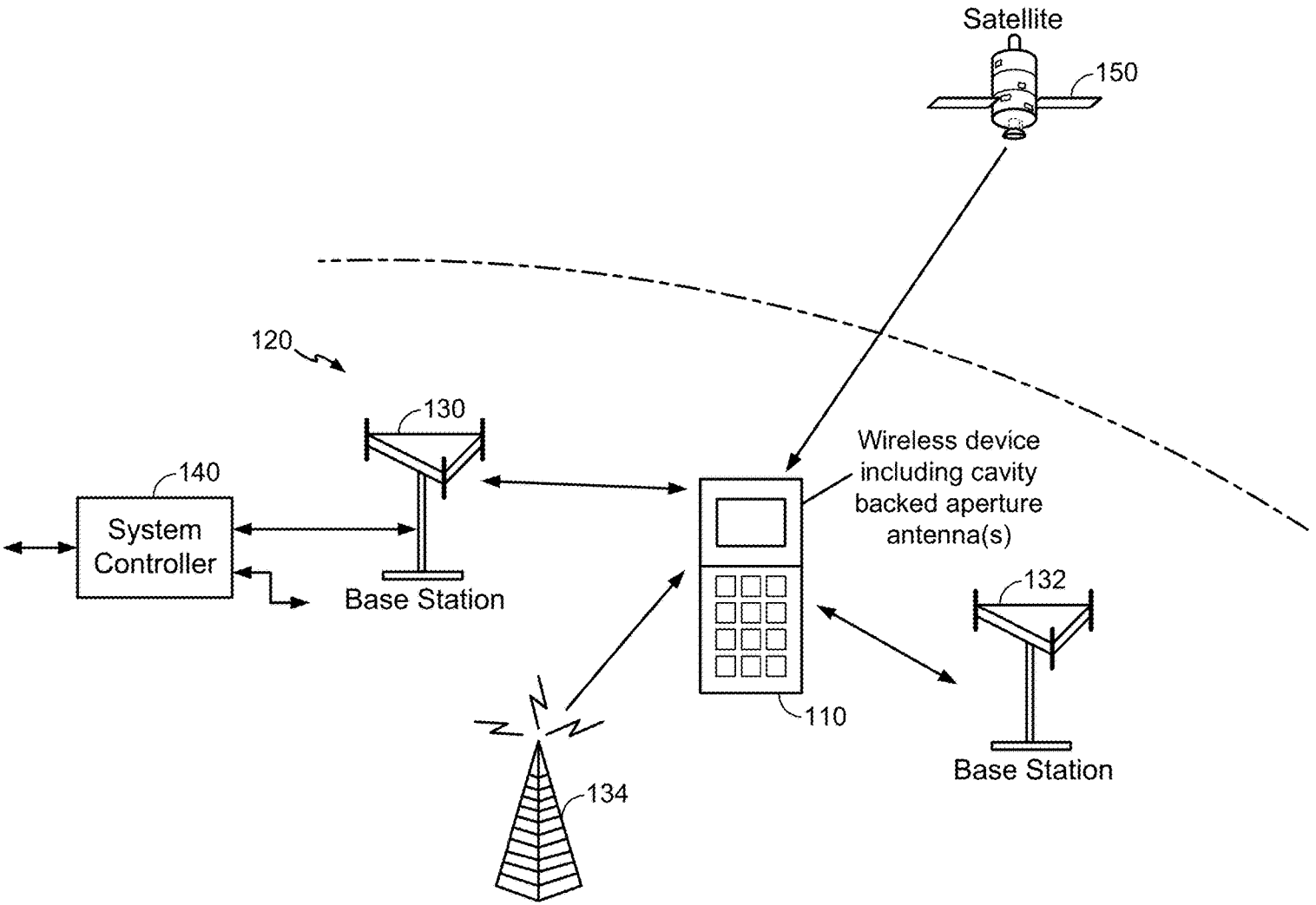
FIG. 1 shows a wireless device that includes a cavity backed slot antenna.

FIG. 1 shows a wireless device 110 communicating with a wireless communication system 120. Wireless communication system 120 may be a Long Term Evolution (LTE) system, a Code Division Multiple Access (CDMA) system, a Global System for Mobile Communications (GSM) system, a wireless local area network (WLAN) system, a wireless system operating in accordance with one or more Institute of Electrical and Electronics Engineers (IEEE) protocols or standards (e.g., IEEE 802.11 ad), a 60 GHz wireless system, a millimeter wave (mm-wave) wireless system, or some other wireless system. A CDMA system may implement Wideband CDMA (WCDMA), CDMA 1X, Evolution-Data Optimized (EVDO), Time Division Synchronous CDMA (TD-SCDMA), or some other version of CDMA. For simplicity, FIG. 1 shows wireless communication system 120 including two base stations 130 and 132 and one system controller 140. In general, a wireless system may include any number of base stations and any set of network entities.

Wireless device 110 may also be referred to as user equipment (UE), a mobile station, a terminal, an access terminal, a subscriber unit, a station, etc. Wireless device 110 may be a cellular phone, a smartphone, a tablet, a wireless modem, a personal digital assistant (PDA), a handheld device, a laptop computer, a smartbook, a netbook, a cordless phone, a wireless local loop (WLL) station, a Bluetooth device, etc. Wireless device 110 may communicate with wireless communication system 120. Wireless device 110 may also receive signals from broadcast stations (e.g., a broadcast station 134), signals from satellites (e.g., a satellite 150) in one or more global navigation satellite systems (GNSS), etc. Wireless device 110 may support one or more radio technologies for wireless communication such as LTE, WCDMA, CDMA 1X, EVDO, TD-SCDMA, GSM, IEEE 802.11ad, wireless gigabit, 60 GHz frequency band communication, mm-wave communication, etc.

Furthermore, in an exemplary embodiment, the wireless device 110 may include one or more cavity backed slot aperture antennas (e.g., as part of one or more antenna arrays), as further described herein. In a particular example, a cavity backed aperture antenna may be a slot antenna having a slot aligned to an edge of a printed circuit board (PC), and vias may be coupled to metal layers of the PC board to create a cavity between the metal layers of the PC board. An illustrative cavity backed aperture antenna is further described with reference to FIG. 3.

In an exemplary embodiment, one or more of the antennas in the wireless device 110 may be a cavity backed horn aperture antenna. For example, the cavity backed horn aperture antenna may include a cavity having a flared section that may be formed by multiple layers of a PC board. A height and/or width of the flared section may be varied. For example, vias may be positioned between metal layers of the PC board to vary the height and/or width of the flared section of the cavity, as further described with reference to FIG. 6. As another example, a horn-shaped antenna may be formed by tapering walls of a housing of the wireless device, as further described with reference to FIG. 7.

Figure 2:
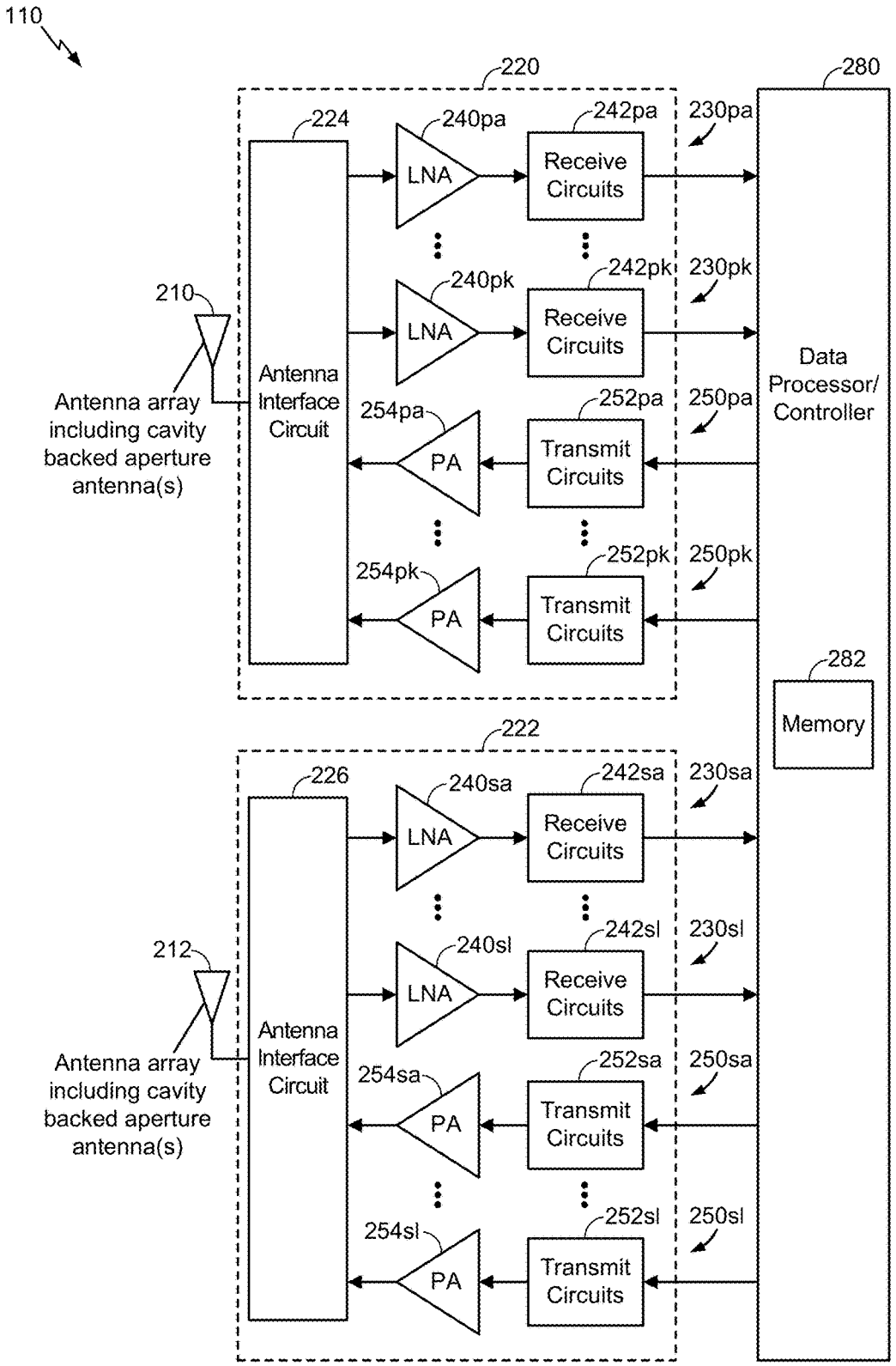
FIG. 2 shows a block diagram of components of the wireless device in FIG. 1.

FIG. 2 shows a block diagram of an exemplary design of components of the wireless device 110. In this exemplary design, the wireless device 110 includes a transceiver 220 coupled to a primary antenna array 210, a transceiver 222 coupled to a secondary antenna array 212, and a data processor/controller 280. Transceiver 220 includes multiple (K) receivers 230*pa* to 230*pk* and multiple (K) transmitters 250*pa* to 250*pk* to support multiple frequency bands, multiple radio technologies, carrier aggregation, etc. Transceiver 222 includes multiple (L) receivers 230*sa* to 230*sl* and multiple (L) transmitters 250*sa* to 250*sl* to support multiple frequency bands, multiple radio technologies, carrier aggregation, receive diversity, multiple-input multiple-output (MIMO) transmission from multiple transmit antennas to multiple receive antennas, etc.

The primary antenna array 210 and/or the secondary antenna array 212 may include one or more cavity backed slot aperture antennas, as further described with reference to FIGS. 3-4. Alternatively, or in addition, the primary antenna array 210 and/or the secondary antenna array 212 may include or more cavity backed horn aperture antennas, as further described with reference to FIGS. 6-7.

In the exemplary design shown in FIG. 2, each receiver 230 includes an LNA 240 and receive circuits 242. For data reception, the primary antenna array 210 receives signals from base stations and/or other transmitter stations and provides a received RF signal, which is routed through an antenna interface circuit 224 and presented as an input RF signal to a selected receiver. Antenna interface circuit 224 may include switches, duplexers, transmit filters, receive filters, matching circuits, etc. The description below assumes that receiver 230*pa* is the selected receiver. Within receiver 230*pa*, an LNA 240*pa* amplifies the input RF signal and provides an output RF signal. Receive circuits 242*pa* downconvert the output RF signal from RF to baseband, amplify and filter the downconverted signal, and provide an analog input signal to data processor/controller 280. Receive circuits 242*pa* may include mixers, filters, amplifiers, matching circuits, an oscillator, a local oscillator (LO) generator, a phase locked loop (PLL), etc. Each remaining receiver 230 in transceivers 220 and 222 may operate in a similar manner as receiver 230*pa*.

In the exemplary design shown in FIG. 2, each transmitter 250 includes transmit circuits 252 and a power amplifier (PA) 254. For data transmission, data processor/controller 280 processes (e.g., encodes and modulates) data to be transmitted and provides an analog output signal to a selected transmitter. The description below assumes that transmitter 250*pa* is the selected transmitter. Within transmitter 250*pa*, transmit circuits 252*pa* amplify, filter, and upconvert the analog output signal from baseband to RF and provide a modulated RF signal. Transmit circuits 252*pa* may include amplifiers, filters, mixers, matching circuits, an oscillator, an LO generator, a PLL, etc. A PA 254*pa* receives and amplifies the modulated RF signal and provides a transmit RF signal having the proper output power level. The transmit RF signal is routed through antenna interface circuit 224 and transmitted via the primary antenna array 210. Each remaining transmitter 250 in transceivers 220 and 222 may operate in a similar manner as transmitter 250*pa*.

FIG. 2 shows an exemplary design of receiver 230 and transmitter 250. A receiver and a transmitter may also include other circuits not shown in FIG. 2, such as filters, matching circuits, etc. All or a portion of transceivers 220 and 222 may be implemented on one or more analog integrated circuits (ICs), RF ICs (RFICs), mixed-signal ICs, etc. For example, LNAs 240 and receive circuits 242 may be implemented on one module, which may be an RFIC, etc. The circuits in transceivers 220 and 222 may also be implemented in other manners. The RFIC may be included in a system in package (SiP) that also includes antennas, such as patch antennas and cavity backed aperture antennas as illustrated in FIG. 4.

Data processor/controller 280 may perform various functions for wireless device 110. For example, data processor/controller 280 may perform processing for data being received via receivers 230 and data being transmitted via transmitters 250. Data processor/controller 280 may control the operation of the various circuits within transceivers 220 and 222. A memory 282 may store program codes and data for data processor/controller 280. Data processor/controller 280 may be implemented on one or more application specific integrated circuits (ASICs) and/or other ICs.

Wireless device 110 may support multiple frequency band groups, multiple radio technologies, and/or multiple antennas. Wireless device 110 may include a number of LNAs to support reception via the multiple frequency band groups, multiple radio technologies, and/or multiple antennas.

Figure 3:
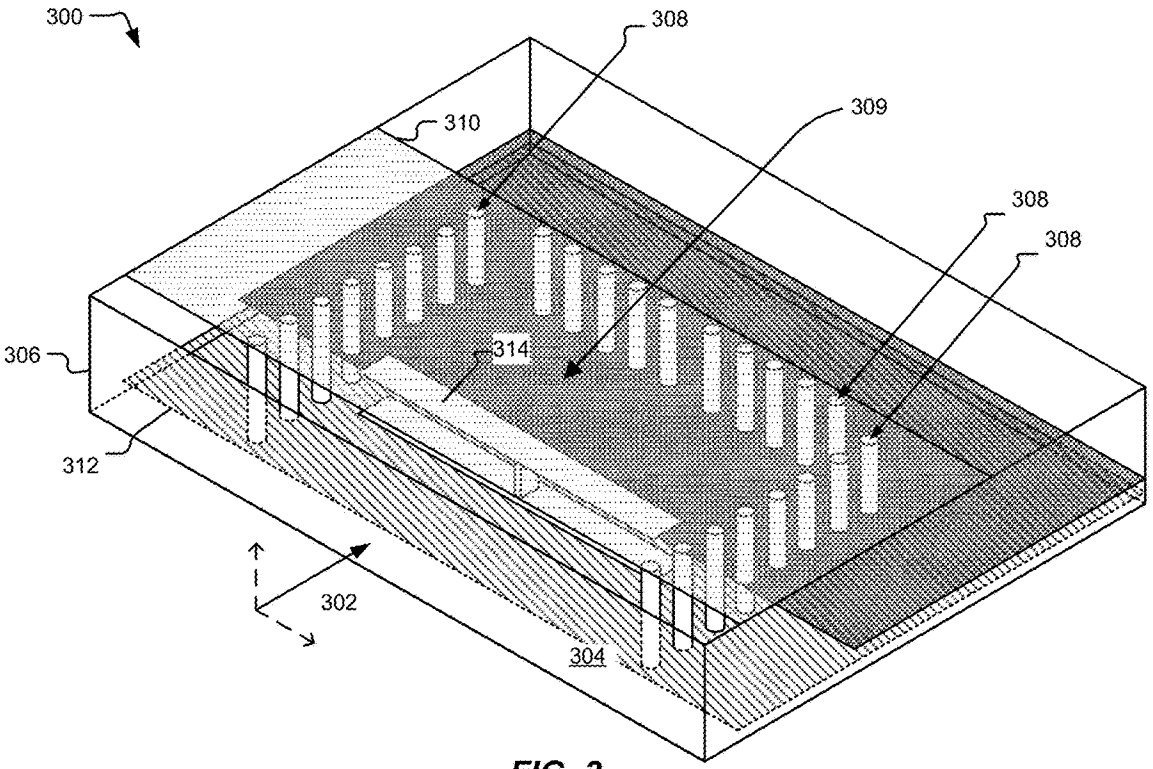
FIG. 3 shows a diagram of an illustrative cavity backed slot aperture antenna that may be used by the wireless device of FIGS. 1-2.

FIG. 3 shows a diagram of an isometric view of an exemplary cavity backed slot aperture antenna 300 that has a slot 302 aligned to an edge 304 of a printed circuit (PC) board 306. The antenna 300 may be one or many antennas of an antenna array, such as the antenna arrays 210-212 of the wireless device 110. Vias 308 are used to create a cavity 309 between metal layers of the PC board 306. For example, a top layer 310 (e.g., a first metal region) of the PC board 306 and a bottom layer 312 (e.g., a second metal region) of the PC board 306 may be used as two sides of the cavity 309 and three sets of the vias 308 may form the three other sides of the cavity 309, as shown in FIG. 3. In this case, the cavity 309 has a shape of a box having a top surface, a bottom surface, three sides (formed by the vias), and an open slot 302 that is aligned to the edge 304 of the PC board 306. The vias 308 connect the bottom surface and the top surface. In this exemplary embodiment, FIG. 3 shows that the slot 302 is fed by a T-Bar resonator 314, although other feeding methods may be used. Thus, a radiating/feeding element of the antenna 300, such as the T-Bar resonator 314, may be located inside (e.g., within) the PC board 306.

In accordance with the present disclosure, a slot may radiate from an edge of a PC board and a probe that excites the slot (e.g., a radiating/feeding element) may be located inside the PC board. In an exemplary embodiment, the cavity backed aperture antenna described may be used to implement one or more antennas in a wireless device that communicates in the mm-wave range. In microwave range antennas, a slot is used to separate ground metal from radiating metal regions so that the antenna is not shorted out. For the mm-wave antenna described herein, a slot may be an active radiating aperture, and metal surrounding the slot may be grounded. The slot may be coupled to a radiator on or within a PC board. Alternatively, the slot may abut an exciting antenna and may radiate as a horn antenna excited by another antenna.

Figure 4:
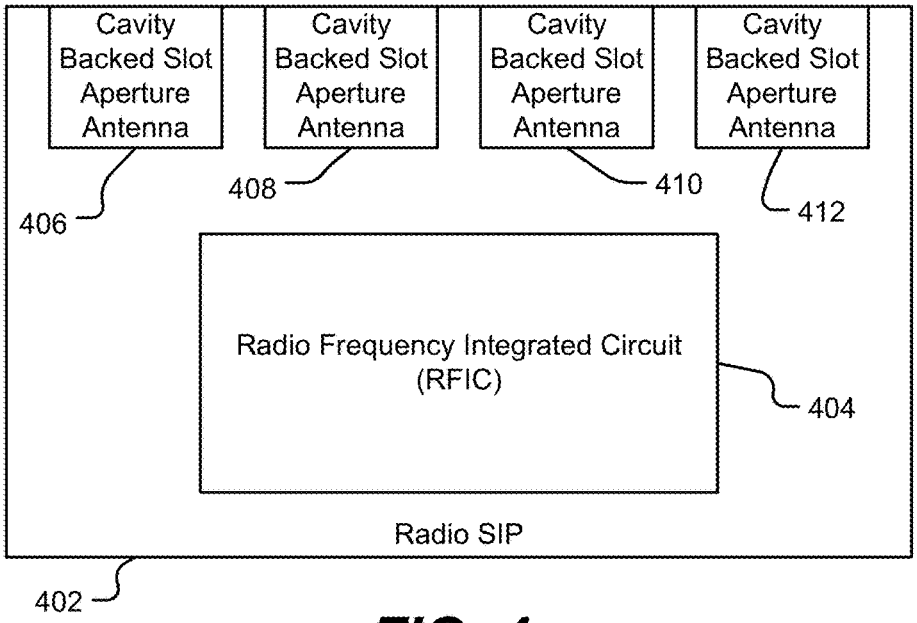
FIG. 4 illustrates a diagram of a radio frequency system in package (SiP) that includes a radio frequency integrated circuit (RFIC) and multiple cavity backed slot aperture antennas.

FIG. 4 shows a system diagram that illustrates a radio frequency system in package (SiP) 402 that includes an RFIC 404 and multiple cavity backed slot aperture antennas 406-412, each of which may have a structure as described with reference to FIG. 3. In an exemplary implementation, the multiple cavity backed slot aperture antennas 406-412 may share a first layer and a second layer of a PC board of the SiP 402, and different sets of vias may be used to form the separate antennas 406-412.

For example, the first cavity backed slot aperture antenna 406 may include a first portion of the PC board that includes a first slot aperture, and the second cavity backed slot aperture antenna 408 may include a second portion of the PC board that includes a second slot aperture. The first cavity backed slot aperture antenna 406 may include a first metal region, a second metal region, and first vias that form a first cavity. The second cavity backed slot aperture antenna 408 may include a third metal region, a fourth metal region, and second vias that form a second cavity. The first metal region and the second metal region may form two sides (e.g., top and bottom) of the first cavity. Similarly, the third metal region and the fourth metal region may form two sides of the second cavity. For example, a first conductive layer at a top surface of the PC board may correspond to the top layer 310 of FIG. 3 and a second conductive layer at a bottom surface of the PC board may correspond to the bottom layer 312 of FIG. 3. The first metal region of the first cavity and the third metal region of the second cavity may be portions of the first conductive layer, and the second metal region of the first cavity and the fourth metal region of the second cavity may be portions of the second conductive layer.

The first vias and the second vias may each form three sides (e.g., side and back walls) of the first cavity and the second cavity, respectively. The first cavity backed aperture antenna 406 may include a first resonator such as the T-Bar resonator 314, and the second cavity backed aperture antenna 408 may include a second resonator. Each of the other cavity backed aperture antennas 410, 412 may have a similar structure as described with respect to the cavity backed aperture antennas 406, 408.

While four antennas are shown in FIG. 4, more than four antennas or less than four antennas may be placed on the PC board of the SiP 402, depending on space availability and design constraints. Although FIG. 4 depicts the antennas 406-412 as spaced apart from each other, in other embodiments two or more of the antennas 406-412 may be adjacent to each other, such as by sharing one or more side walls. To illustrate, a single wall of vias may separate the first cavity (of the first cavity backed aperture antenna 406) from the second cavity (of the second cavity backed aperture antenna 408). While not shown in FIG. 4, in another exemplary embodiment, the RFIC 404 may include other types of antennas (e.g., patch, monopole, or dipole antennas). Antenna elements may be placed in locations in or around the RFIC 404 on the PC board to provide coverage diversification. For example, the cavity backed slot aperture antennas 406-412 may be vertically polarized with respect to the PC board edge to complement dipole antennas included in the RFIC 404 that are horizontally polarized.

Figure 5A:
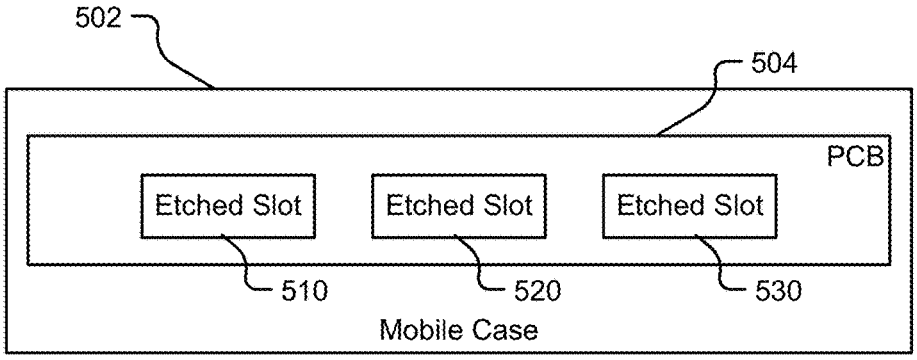
FIG. 5A shows a diagram of openings in a housing of a mobile phone.
Figure 5B:
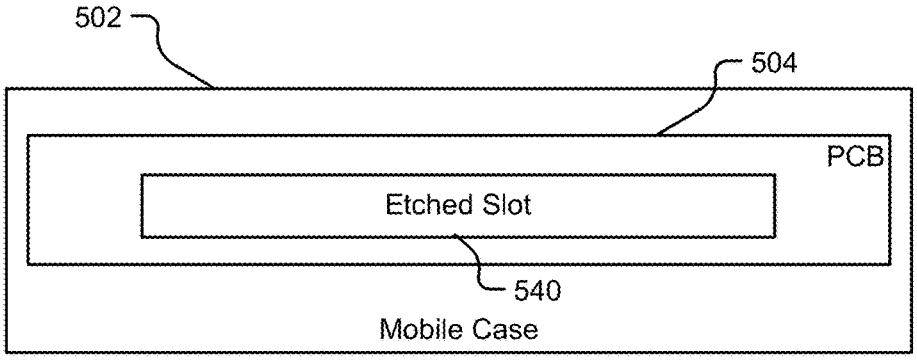
FIG. 5B shows another diagram of openings in a housing of a mobile phone.

Because the disclosed exemplary antenna 300 is an aperture antenna, placing the antenna in a metal environment, such as proximate to other metal structures (e.g., a metal case of a mobile phone), may beneficially impact the performance of the antenna 300 (as opposed to dipole antennas having performance adversely impacted by the metal environment). As an exemplary embodiment, openings in a housing of a mobile phone may align with aperture(s) of the cavity backed slot aperture antenna(s). For example, at least one of the exemplary cavity backed slot aperture antennas may be proximate to an opening in the housing. FIG. 5A and FIG. 5B show exemplary embodiments of etched slots in a mobile case (e.g., housing). In the exemplary embodiment of FIG. 5A, multiple antennas are on a PC board 504, and an etched slot 510, 520, 530 is in front of each antenna opening in a mobile case 502. In the exemplary embodiment of FIG. 5B, a single slot 540 is in front of an array of antennas. One or more of the slots 510-540 may align with (or may be proximate to) a cavity backed aperture antenna (e.g., of the SiP 402). Thus, the disclosed exemplary antennas provide improved performance in a metal environment and provide increased flexibility for RF module design and placement at various locations of a housing.

Figure 6:
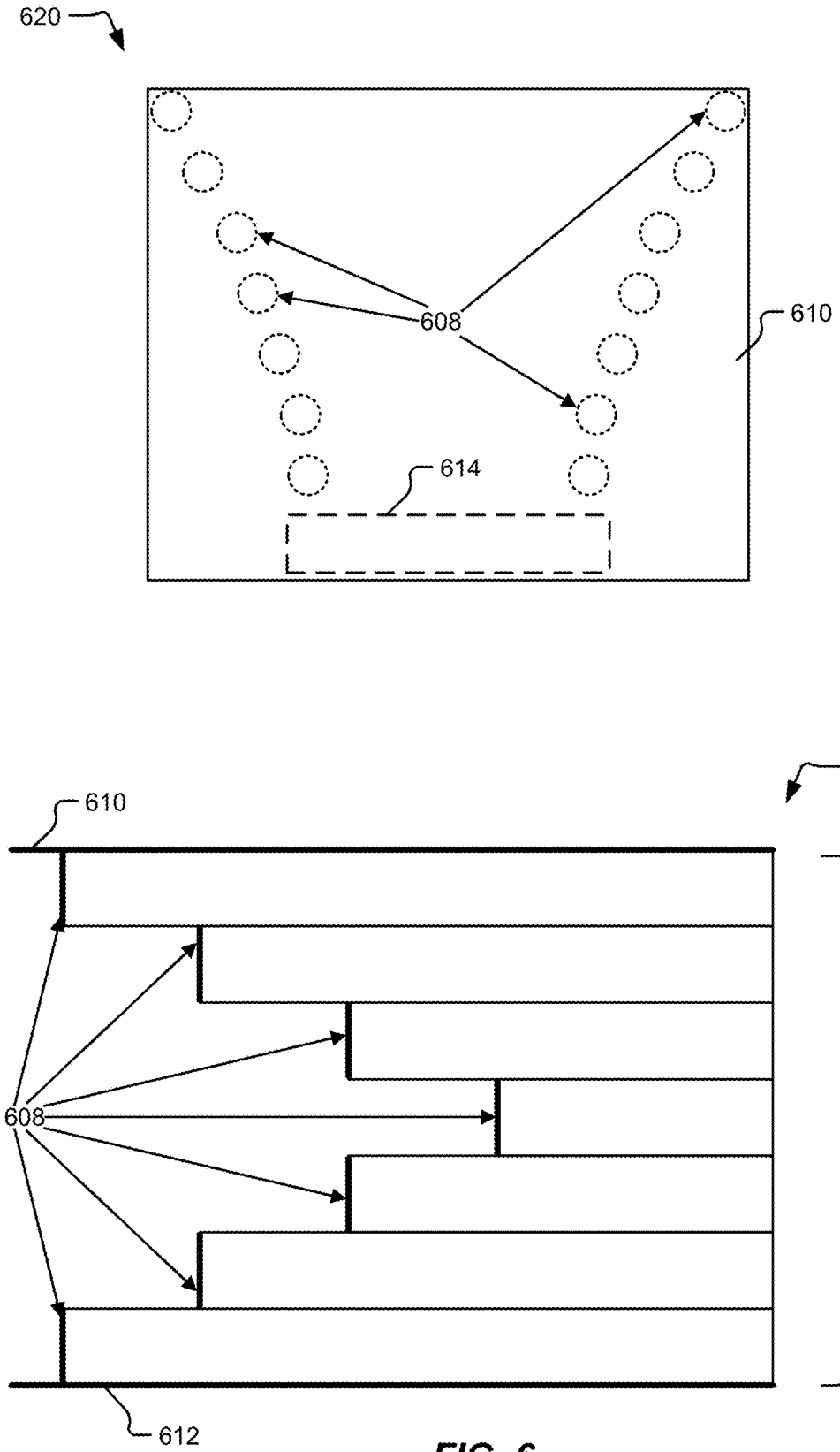
FIG. 6 shows a diagram of an illustrative cavity backed horn aperture antenna.

While a slot type of cavity is shown in FIG. 3, it should be noted that other cavity types may be used. For example, a step cavity may be used, where the cavity "steps down" (by using multiple layers of the PC board the cavity can start with a wide height and the height can decrease step by step in a direction into the interior of the PC board). In another exemplary embodiment, as illustrated in FIG. 6, a horn type antenna may be formed. The horn antenna may use vias in a flare shape that increases the flare of a feedforward antenna. FIG. 6 illustrates a top-down view 620 of a cavity backed horn aperture antenna and a cross-sectional view 630 of a cavity backed horn aperture antenna. The cavity backed horn aperture antenna is formed between a top layer (e.g., metal region) 610 of a PC board 606, a bottom layer (e.g., metal region) 612 of the PC board 606, and vias 608. The cavity backed horn aperture antenna may also include a radiating or feeding element 614, such as a T-Bar resonator or other element. In the top-down view, the element 614 and the vias 608 are shown in dashed line to signify that they are underneath the top layer 610. In an exemplary embodiment, as shown in the top-down view 620, a width of the cavity can be flared based on positioning of the vias 608 that connect layers of the PC board 606 to form the cavity. Alternatively, or in addition, as shown in the cross-sectional view 630, a height of the cavity can be flared based on positioning and connections of the vias 608. The present disclosure thus illustrates cavity backed horn aperture antennas having flared width, flared height, or both.

Figure 7:
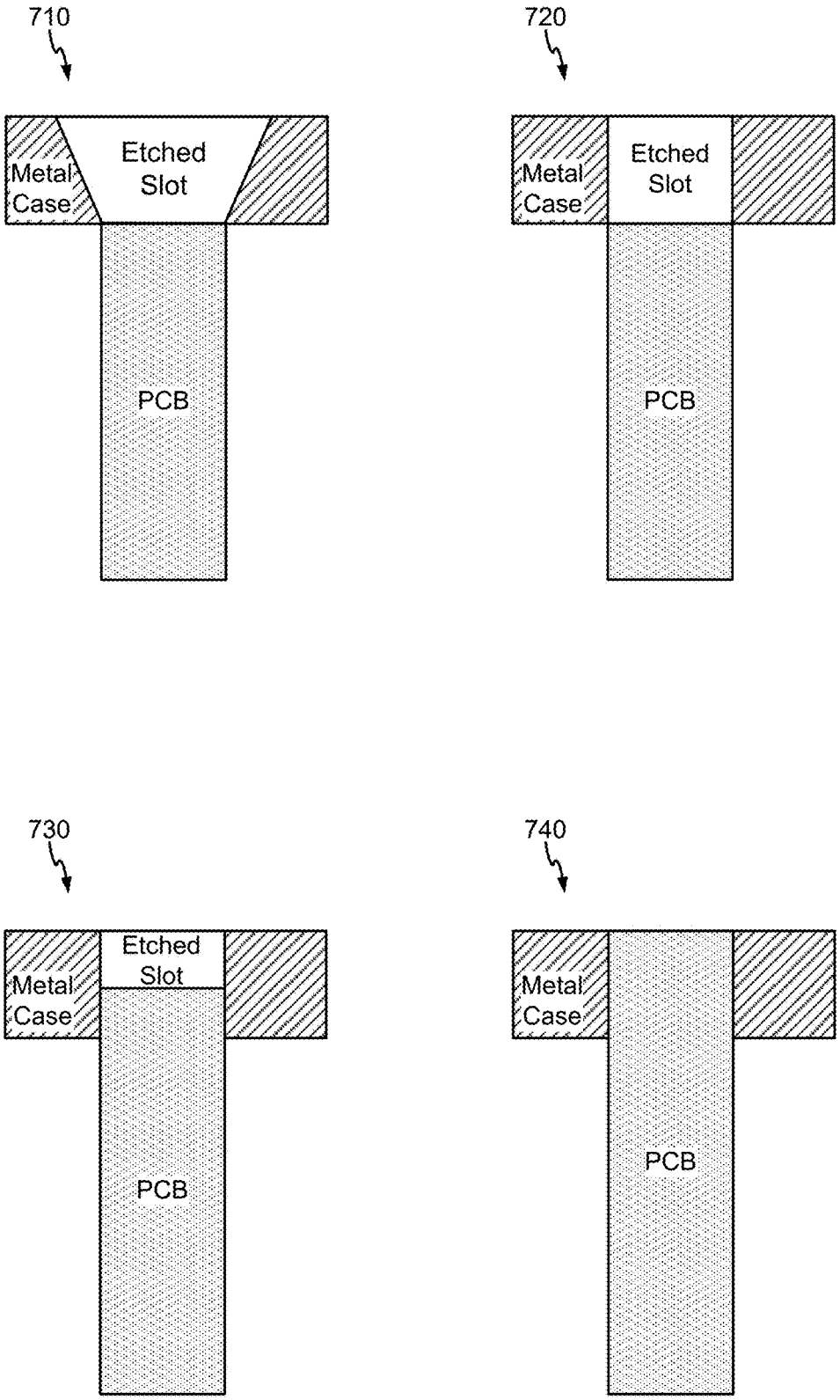
FIG. 7 illustrates positional relationships between a housing of a mobile phone and a printed circuit board.

Whereas FIG. 6 illustrates exemplary embodiments of a horn antenna that includes a taper in a PC board, in alternative embodiments, a horn antenna may be formed by tapering walls of a mobile device (or case). For example, as shown at 710 of FIG. 7, an etched slot formed in a metal case of a mobile device may be tapered. FIG. 7 also illustrates alternative positional relationships between the PC board and the metal case. At 720 and 730, exemplary embodiments including a rectangular etched slot are illustrated. At 740, an exemplary embodiment in which the PC board extends to the outer edge of the metal case is shown.

Figure 8:
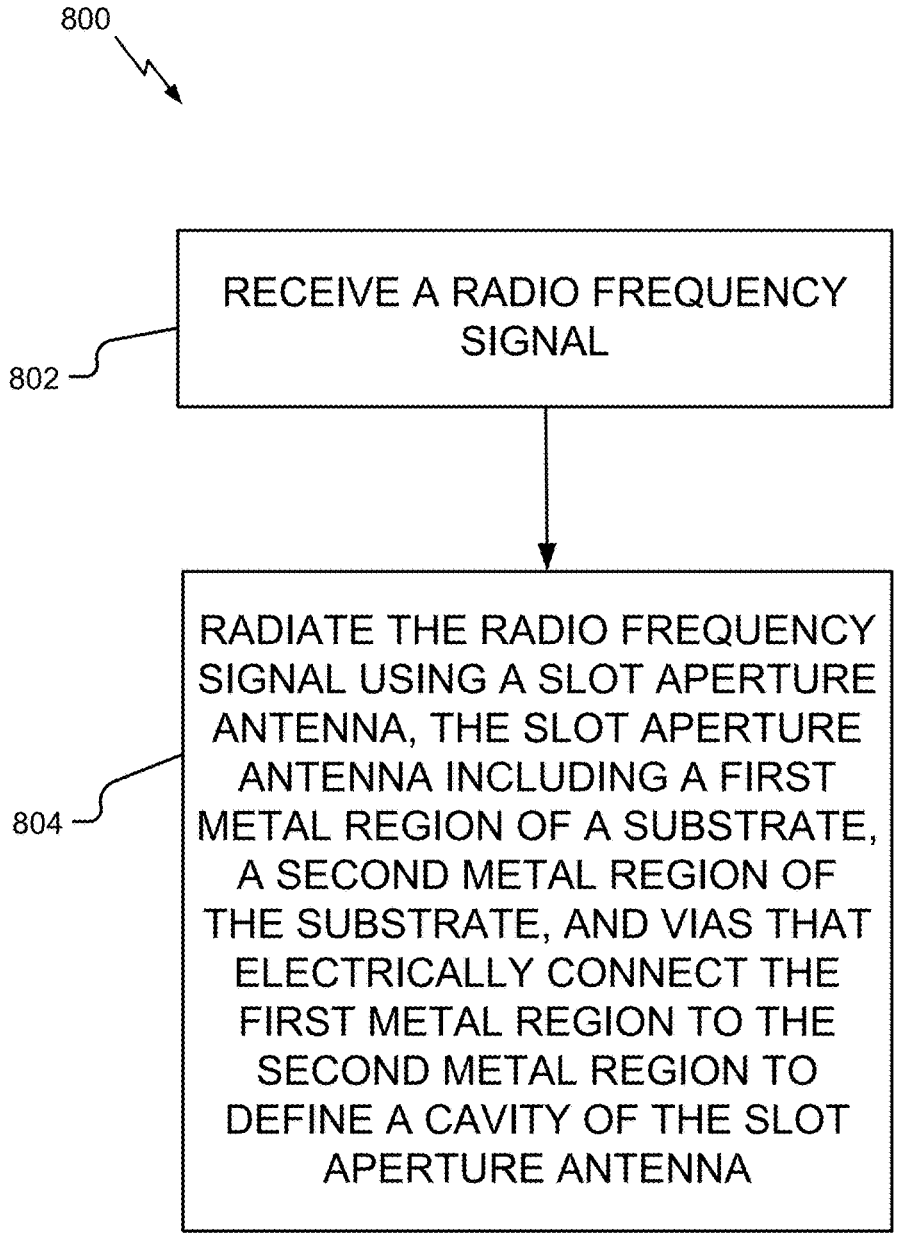
FIG. 8 illustrates a flowchart showing a method of communication using a cavity backed slot aperture antenna.

FIG. 8 shows a flowchart of a method 800 of operation at a wireless device, such as the wireless device 110. The method 800 may include receiving a radio frequency signal, at 802. For example, the radio frequency signal may be received from a radio frequency circuit, at 802. The method 800 may also include radiating the radio frequency signal using a slot aperture antenna, at 804. The slot aperture antenna includes a first metal region of a substrate, a second metal region of the substrate, and vias that electrically connect the first metal region to the second metal region to form a cavity of the slot aperture antenna. For example, referring to FIG. 3, the cavity backed slot aperture antenna 300 may radiate a signal received from a radio frequency circuit (e.g., the RFIC 400 of FIG. 4). The cavity backed slot aperture antenna 300 includes vias 308 connecting metal layers of the PC board 306. The cavity backed slot antenna may also receive external signals and provide such signals to RF circuitry.

In conjunction with the described embodiments, an apparatus includes first means for conducting at a first region of a substrate. The first means for conducting may include the top layer 310 or the bottom layer 312 of FIG. 3, a metal region of the PC board of the SiP 402 of FIG. 4, the top layer 610 or the bottom layer 612 of FIG. 6, or any combination thereof, as an illustrative, non-limiting example.

The apparatus may include second means for conducting at a second region of the substrate. The second means for conducting may include the top layer 310 or the bottom layer 312 of FIG. 3, a metal region of the PC board of the SiP 402 of FIG. 4, the top layer 610 or the bottom layer 612 of FIG. 6, or any combination thereof, as an illustrative, non-limiting example.

The apparatus may include means for electrically connecting the first region to the second region to define a cavity of a slot aperture antenna. The means for electrically connecting may include the vias 308 of FIG. 3, the first vias or the second vias of the PC board of the SiP 402 of FIG. 4, the vias 608 of FIG. 6, or any combination thereof, as an illustrative, non-limiting example.

Those of skill in the art would understand that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Those of skill would further appreciate that the various illustrative logical blocks, configurations, modules, circuits, and algorithm steps described in connection with the embodiments disclosed herein may be implemented as electronic hardware, computer software executed by a processor, or combinations of both. Various illustrative components, blocks, configurations, modules, circuits, and steps have been described above generally in terms of their functionality. Whether such functionality is implemented as hardware or processor executable instructions depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the embodiments disclosed herein may be embodied directly in hardware, in a software module executed by a processor, or in a combination of the two. A software module may reside in random access memory (RAM), flash memory, read-only memory (ROM), programmable read-only memory (PROM), erasable programmable read-only memory (EPROM), electrically erasable programmable read-only memory (EEPROM), registers, hard disk, a removable disk, a compact disc read-only memory (CD-ROM), or any other form of non-transient storage medium known in the art. An exemplary storage medium is coupled to the processor such that the processor can read information from, and write information to, the storage medium. In the alternative, the storage medium may be integral to the processor. The processor and the storage medium may reside in an application-specific integrated circuit (ASIC). The ASIC may reside in a computing device or a user terminal. In the alternative, the processor and the storage medium may reside as discrete components in a computing device or user terminal.

The previous description of the disclosed embodiments is provided to enable a person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

What is claimed is:

1. An apparatus comprising:

a first metal region of a substrate of a printed circuit board;

a second metal region of the substrate; and vias that electrically connect the first metal region to the second metal region to define a cavity of a slot aperture antenna, wherein the slot aperture antenna is aligned with an opening in a case of a mobile device, and wherein an edge of the printed circuit board is disposed at least partially within the opening.

2. The apparatus of claim 1, wherein the substrate includes a bottom layer corresponding to the first metal region and a top layer corresponding to the second metal region.

3. The apparatus of claim 2, wherein the vias couple the bottom layer and the top layer.

4. The apparatus of claim 1, wherein the vias form multiple sides of the cavity.

5. The apparatus of claim 1, wherein the slot aperture antenna includes a T-Bar resonator.

6. The apparatus of claim 1, further comprising a second antenna, wherein the slot aperture antenna has a first polarization direction and the second antenna has a second polarization direction.

7. The apparatus of claim 1, wherein multiple layers of the substrate vary a height of a flared section of the cavity.

8. The apparatus of claim 1, wherein a subset of the vias vary a width of a flared section of the cavity.

9. The apparatus of claim 1, further comprising a plurality of cavity backed slot aperture antennas, the plurality of cavity backed slot aperture antennas including the slot aperture antenna, wherein the plurality of cavity backed slot aperture antennas are aligned with the opening.

10. The apparatus of claim 1, further comprising a radio frequency integrated circuit attached to the substrate, wherein a first portion of the substrate includes the slot aperture antenna, wherein a second portion of the substrate includes a second slot aperture antenna.

11. The apparatus of claim 1, wherein the slot aperture antenna comprises a cavity backed horn aperture antenna that includes a flared section formed by tapered walls of the case.

12. A method of communication comprising:

receiving a radio frequency signal; and radiating the radio frequency signal using a slot aperture antenna, the slot aperture antenna including a first metal region of a substrate of a printed circuit board, a second metal region of the substrate, and vias that electrically connect the first metal region to the second metal region to define a cavity of the slot aperture antenna, wherein the slot aperture antenna is aligned with an opening in a case of a mobile device, and wherein an edge of the printed circuit board is disposed at least partially within the opening.

13. The method of claim 12, wherein the slot aperture antenna has a first polarization direction, and further comprising radiating a second radio frequency signal at a second slot aperture antenna having a second polarization direction.

14. An apparatus comprising:

first means for conducting at a first region of a substrate of a printed circuit board;

second means for conducting at a second region of the substrate; and means for electrically connecting the first region to the second region to define a cavity of a slot aperture antenna, wherein the slot aperture antenna is aligned with an opening in a case of a mobile device, and wherein an edge of the printed circuit board is disposed at least partially within the opening.

15. The apparatus of claim 14, wherein the substrate includes a bottom layer and a top layer, and wherein the means for electrically connecting includes multiple vias that couple the bottom layer and the top layer.

16. The apparatus of claim 14, wherein the cavity has a flared section formed by multiple layers of the substrate.

17. The apparatus of claim 14, wherein the means for electrically connecting includes vias, and wherein the cavity has a flared section formed by a subset of the vias that vary a width of the flared section.

18. The apparatus of claim 1, wherein the edge of the printed circuit board is aligned with an outside edge of the opening.

19. The apparatus of claim 1, wherein the case is a metal case, and wherein the opening corresponds to a slot that is defined by at least the printed circuit board and the case.

20. The apparatus of claim 1, further comprising a plurality of cavity backed slot aperture antennas, the plurality of cavity backed slot aperture antennas including the slot aperture antenna, wherein a second cavity backed slot aperture antenna of the plurality of cavity backed slot aperture antennas is aligned with a second opening in the case.

* * * * *